US007959352B2

(12) United States Patent
Bonnet et al.

(10) Patent No.: US 7,959,352 B2
(45) Date of Patent: Jun. 14, 2011

(54) TIMEPIECE CROWN INCLUDING AN UNCOUPLING MECHANISM

(75) Inventors: Pierre-Jean Bonnet, Courtelary (CH); Georges Zimmermann, Küttigkofen (CH)

(73) Assignee: Meco S.A., Grenchen (CH)

( * ) Notice: Subject to any disclaimer, the term of this patent is extended or adjusted under 35 U.S.C. 154(b) by 30 days.

(21) Appl. No.: 12/249,074

(22) Filed: Oct. 10, 2008

(65) Prior Publication Data

US 2009/0122657 A1 May 14, 2009

(30) Foreign Application Priority Data

Nov. 8, 2007 (EP) ..... 07120279

(51) Int. Cl.
*G04B 3/00* (2006.01)
*G04B 3/06* (2006.01)

(52) U.S. Cl. ..... 368/319; 368/308

(58) Field of Classification Search ..... 368/288–290, 368/306–308, 319–321
See application file for complete search history.

(56) References Cited

U.S. PATENT DOCUMENTS

| | | | | |
|---|---|---|---|---|
| 2,571,878 | A | 10/1951 | Hill et al. | |
| 2,637,987 | A | 5/1953 | Hill et al. | |
| 2,669,833 | A | 2/1954 | Hill et al. | |
| 3,362,154 | A * | 1/1968 | Perret | 368/290 |
| 3,389,550 | A * | 6/1968 | Piquerez | 368/308 |
| 4,089,158 | A * | 5/1978 | Wenger | 368/216 |
| 4,534,660 | A | 8/1985 | Laesser | |
| 4,623,262 | A | 11/1986 | Gogniat et al. | |
| 4,702,612 | A | 10/1987 | Finger | |
| 7,192,184 | B2 * | 3/2007 | Hiranuma et al. | 368/319 |
| 7,384,190 | B2 | 6/2008 | Zimmermann | |
| 2007/0025190 | A1 * | 2/2007 | Cretin | 368/319 |
| 2009/0122656 | A1 * | 5/2009 | Bonnet et al. | 368/308 |

FOREIGN PATENT DOCUMENTS

| | | | |
|---|---|---|---|
| CH | 684453 | A3 | 9/1994 |
| EP | 1 586 690 | A1 | 10/2005 |
| EP | 1 586 960 | A1 | 10/2005 |

OTHER PUBLICATIONS

Australian Search Report issued in co-pending related Singapore application No. SG 200807882-6, completed Feb. 12, 2009 and mailed Feb. 19, 2009.
Office Action issued in co-pending U.S. Appl. No. 12/249,054, mailed Jun. 24, 2009.
European Search Report issued in a related application No. EP 07 12 0281, completed Jul. 31, 2008.
European Search Report issued in corresponding application No. EP 07 12 0279, completed Jul. 28, 2008.

* cited by examiner

*Primary Examiner* — Sean Kayes
(74) *Attorney, Agent, or Firm* — Griffin & Szipl, P.C.

(57) ABSTRACT

Winding crown for a timepiece, said crown (32) including an uncoupling mechanism (1) comprising a rigid drive ring (4, 400) secured to the crown (32) and cooperating with at least one elastically deformable element (2; 200) secured to a pipe (12) to one end of which a winding stem is secured, the rigid ring (4; 400) driving the deformable elastic element (2; 200) in at least one rotational direction until the resistant torque opposed by said elastic element (2; 200) exceeds a threshold value beyond which said elastic element (2; 200) is deformed so as to interrupt the drive connection thereof with the rigid ring (4; 400), the elastically deformable element (2; 200) therefore having means for temporary coupling said element to said rigid drive ring (4; 400), the crown (32)) being characterized in that the elastically deformable element (2; 200) includes means for centring said element relative to the rigid drive ring (4; 400).

5 Claims, 3 Drawing Sheets

TIMEPIECE CROWN INCLUDING AN UNCOUPLING MECHANISM

This application claims priority from European Patent Application No. 07120279.0 filed Aug. 11, 2007, the entire disclosure of which is incorporated herein by reference.

FIELD OF THE INVENTION

The present invention concerns a timepiece crown including an uncoupling mechanism. More specifically, the present invention concerns a crown of this type which prevents the user damaging the timepiece movement, in particular when he winds the mainspring.

BACKGROUND OF THE INVENTION

A crown of the aforementioned type is known for example from EP Patent Application No. 1 586 960 in the name of the Applicant. The crown essentially includes a cap delimited at the bottom by a circular skirt, which has a plurality of flutes on the external surface thereof for facilitating handling of the crown by the user. The circular skirt delimits a hollow cylindrical housing inside which the uncoupling mechanism is arranged. The uncoupling mechanism includes, among other things, a rigid ring, which has a plurality of notches on the inner periphery thereof for cooperating with one or more generally circular spring elements in order to achieve the uncoupling function. In fact, the notched ring is secured to the crown whereas the spring elements are secured to a pipe onto which is screwed a winding stem, which acts on the winding mechanism for the mainspring. Provided that the resistant torque opposed by the spring elements is less than a predetermined value, the spring elements are driven in rotation by the rigid ring under the effect of the user activating the crown. In turn, the spring elements drive the pipe on which they are mounted and thus the winding stem. When the resistant torque opposed by the spring elements becomes greater than the predetermined value, because the mainspring is completely wound, said spring elements will deform elastically in response to activation of the rigid ring and will escape therefrom by sliding. The result of this is that the crown activated by the user will rotate without transmission of any torque. The mainspring is therefore protected from any excessive winding which could damage it.

The top end of the pipe has a projecting portion, for example square-shaped and inscribed in a hole, which is also square, made in the springs via which said springs are secured to said pipe. Thus, when a rotational movement is imparted to the springs, the latter drive the pipe in rotation via its projecting portion.

With use, the crown described above has a problem. When the pipe is not perfectly aligned axially with the crown and a play thus appears between these two parts, the springs, rigidly coupled to said pipe, are no longer suitably centred relative to the notched rigid crown. When the notched ring is driven in rotation, the springs can then pass from their normal elastic deformation state, to a plastic deformation state in which they undergo irreversible damage. A substantial drop is then observed in the threshold torque value that determines the transition between the state in which the notched ring drives the springs in rotation and the state in which said notched ring slides over said springs without driving them, which consequently means that the user is no longer able to wind the mainspring in an optimum manner.

SUMMARY OF THE INVENTION

It is an object of the present invention to overcome the resistance problems of the aforementioned materials, the tribological and other problems by providing a new type of uncoupling mechanism for a timepiece winding crown whose torque value, which marks the uncoupling between the rigid notched ring and the spring elements, remains stable over time.

The present invention therefore concerns a winding crown for a timepiece, said crown including an uncoupling mechanism including a rigid driving ring secured to the crown and cooperating with at least one elastically deformable element secured to a pipe to one end of which a winding stem is secured, the rigid ring driving the elastic deformable element in at least one direction of rotation until the resistant torque opposed by said elastic element exceeds a threshold value beyond which said elastic element is deformed so as to interrupt the drive connection thereof to the rigid ring, the crown being characterized in that the elastically deformable element includes means enabling it to be centred relative to the rigid drive ring.

Owing to these features, the present invention provides a timepiece crown wherein the elastically deformable element of the uncoupling mechanism includes its means of its own for centring said element relative to the rigid drive ring secured to the crown. Axial disalignment between the pipe to which the elastically deformable element is secured and the crown thus has no effect on the centring of said deformable element relative to the drive ring. Consequently, if any such disalignment is observed, the deformable element will remain in a state in which it deforms elastically under the effect of stresses exerted by the rigid ring and will not enter a plastic deformation domain in which it could be irreversibly damaged. Thus, the operating features of the uncoupling mechanism according to the invention will be preserved over time. In particular, no significant drop will be observed in the torque value that marks the passage between the state in which the rigid ring is meshed with the deformable element and the state in which the rigid ring is uncoupled from the deformable element.

According to a complementary feature of the invention, the elastically deformable element is circular and the centring means are arranged at least in a diametrically opposite manner on the perimeter of said elastically deformable element.

Owing to this feature, the elastically deformable element is perfectly symmetrically centred relative to the centre of the rigid drive ring.

According to another embodiment of the invention, the centring means are provided at three places distributed at regular intervals on the perimeter of the elastically deformable element.

Owing to this variant, the efforts exerted on the elastically deformable element are distributed in an optimum manner if the pipe is not perfectly axially aligned with the crown.

BRIEF DESCRIPTION OF THE DRAWINGS

Other features and advantages of the present invention will appear more clearly from the following detailed description of two embodiments of the crown according to the invention, these examples being given purely by way of non limiting illustration with reference to the annexed drawing, in which.

DETAILED DESCRIPTION OF THE PREFERRED EMBODIMENTS

The present invention proceeds from the general inventive idea that consists in providing a timepiece crown including an uncoupling mechanism for protecting the timepiece movement against excessive winding of the mainspring, said uncoupling mechanism including an elastically deformable element, which possesses means for centring said element perfectly relative to the rigid drive ring. Thus, if the pipe to which the elastic element is secured is not perfectly axially aligned relative to the crown carrying the rigid drive ring, the elastically deformable element is not off-centre relative to the rigid drive ring and thus is not liable to pass from an elastic deformation state to a plastic deformation state in which it would undergo irreversible plastic deformation.

Figure 1:
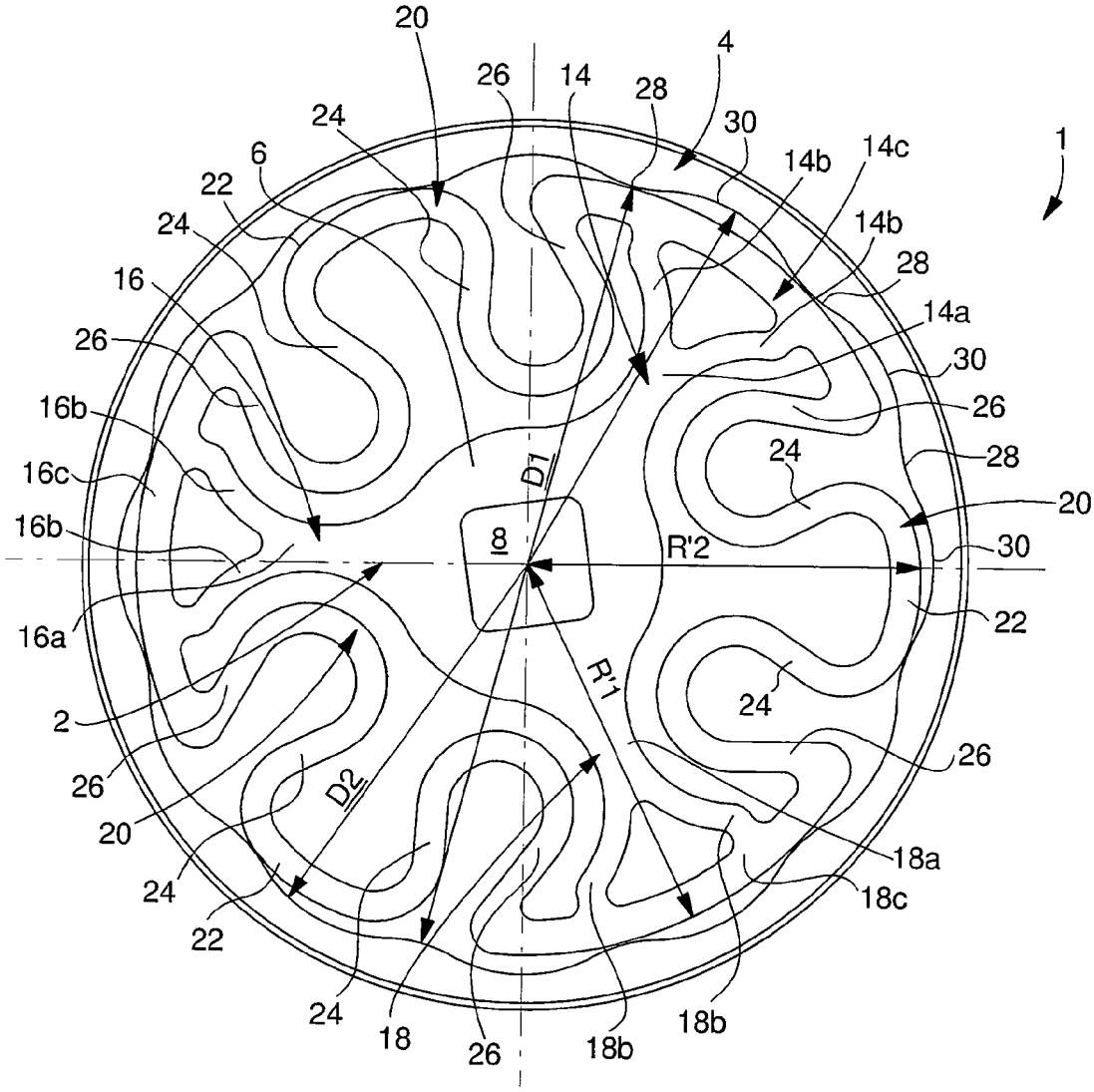
FIG. 1 is a plan view of a first embodiment of the elastically deformable element according to the invention.

A first example of an uncoupling mechanism according to the invention is shown with reference to FIG. 1. Designated as a whole by the general reference numeral 1, this uncoupling mechanism includes an elastically deformable element 2 and a rigid drive ring 4.

The elastically deformable element 2 is typically an element of generally circular shape. It includes a base 6 that is also substantially circular, pierced at the centre thereof with a hole 8 of, for example, square shape via which it is secured to a projecting portion 10 of complementary shape to that of hole 8 of a pipe 12 (see FIG. 3) to the end of which a winding stem (not shown) is secured.

According to the invention, the spring element 2 includes means for centring said element relative to rigid drive ring 4. In the example shown in FIG. 1, these centring means take the form of three Y-shaped arms 14, 16 and 18 which extend radially from base 6 and which are spaced at regular angles from each other.

Spring element 2 also includes means for temporarily coupling it to rigid drive ring 4. In the example shown in FIG. 1, these coupling means are shown as Ω shaped parts 20. There are three of these parts 20, each arranged between two successive centring arms. Each coupling part 20 includes a head 22 and two legs 24, which define an surface open towards the inside of spring element 2.

More specifically, coupling arms 14-18 each include a section 14*a*-18*a*, which extends radially from base 6 of spring element 2 and which is separated into two symmetrical branches 14*b*-18*b* which spread apart from each other. The two branches 14*b*-18*b* of each arm 14-18 are joined to each other by a centring portion 14*c*-18*c* in the arc of a circle, which is extended at the free ends thereof by connecting portions 26 which connect centring arms 14-18 to feet 24 of temporary coupling parts 20.

The inner perimeter of rigid drive ring 4 has an uninterrupted series of bumps 28 and hollows 30 which respectively define first and second inner diameters D1 and D2, inner diameter D1 being smaller than inner diameter D2.

As can be seen upon examining FIG. 1, centring portions 14*c*-18*c* in the arc of a circle of arms 14-18 define a first external radius R'1 of spring element 2, which corresponds to a diameter equal to first inner diameter D1 of rigid drive ring 4. Since, moreover, the length of centring portions 14*c*-18*c* is such that these portions 14*c*-18*c* always rest on two bumps 28 on the inner perimeter of drive ring 4, it is clear that the position of these centring portions 14*c*-18*c* relative to drive ring 4 will remain unchanged whatever the angular position of said drive ring 4. Bumps 28 of drive ring 4 thus constitute a rolling path for spring element 2 along which centring portions 14*c*-18*c* move. Spring element 2 is thus perfectly positioned relative to the centre of rigid drive ring 4, such that any axial alignment of pipe 12, to which said spring element 2 is secured, relative to crown 32 to which said rigid ring 4 is secured has no effect on the relative positioning of said spring element 2 and said rigid ring 4. Rigid ring 4 is thus not liable to enter a plastic deformation zone in which it could undergo irreversible damage which could lead to a decrease the threshold torque value that marks the passage between the state in which rigid ring 4 drives spring element 2 and the state in which spring element 2 is elastically deformed to escape from the hold of rigid ring 4 by losing adherence.

Spring element 2 is driven by rigid ring 4 via the cooperation between the coupling parts 20 and bumps 28. It should be noted that the tip of heads 22 of coupling parts 20 defines a second external radius R'2 of spring element 2, which corresponds to a greater diameter than the first inner diameter D1 of rigid ring 4. Thus, rotating crown 32 drives rigid ring 4 in rotation. In turn, rigid ring 4 will drive in rotation spring element 2, bumps 28 of said rigid ring 2 abutting against heads 22 of coupling parts 20. This is true until spring element 2 opposes a resistant torque such that coupling parts 20 are elastically deformed and the heads 22 thereof pass under bumps 28. At that moment, rigid ring 4 no longer grips spring element 2 and crown 32 rotates without transmitting any torque. It will be noted that coupling parts 20 work partly in compression along a radius in which spring element 2 is inscribed and not only along a tangential direction to the perimeter of said spring element 2, which limits the fatigue of said coupling parts 20 and also increases their resistance to wear.

Figure 2:
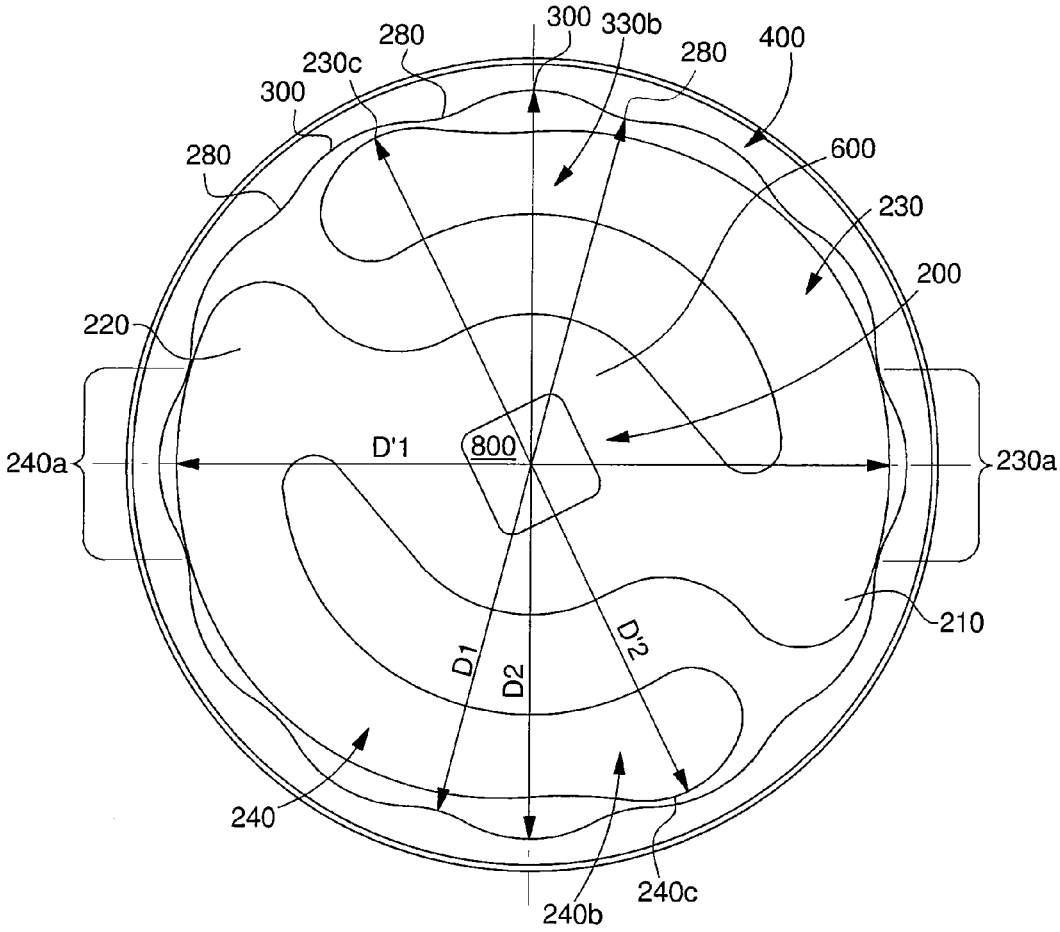
FIG. 2 is a plan view of a second embodiment of the elastically deformable element according to the invention.

A second embodiment of the uncoupling mechanism according to the invention is illustrated in FIG. 2. It includes an elastically deformable element 200 and a rigid drive ring 400.

Rigid drive ring 400 has the same shape and structure as rigid ring 4 described with reference to FIG. 1. It includes an uninterrupted series of bumps 280 and hollows 300, which respectively define first and second inner diameters D1 and D2, inner diameter D1 being smaller than inner diameter D2.

Elastically deformable element 200 is of the spring type and is generally of circular shape. It includes a base 600, which is also substantially circular, pierced at the centre thereof with a hole 800 of square shape via which said element is secured to the projecting portion 10 of square contour of pipe 32 (see FIG. 3) to the end of which the winding stem (not shown) is secured.

Base 600 of spring element 200 is extended by two diametrically opposite bent portions 210 and 220 which are followed by arms 230 and 240 of similar shape to that of the arc of a circle. As can be seen upon examining FIG. 2, arms 230 and 240 both extend anticlockwise. Of course, it would be entirely possible for arms 230, 240 to extend in the same clockwise direction.

More specifically, each of the two arms 230 and 240 includes a centring portion 230*a*, 240*a* and a coupling portion 230*b*, 240*b*. Centring portions 230*a*, 240*a* have the shape of an arc of a circle and define a first external diameter D'1 of spring element 200 which is equal to the first inner diameter D1 of rigid drive ring 400. The length of centring portions 230*a*, 240*a* is such that these centring portions 230*a*, 240*a* always rest on two successive bumps 280 of the inner perimeter of rigid drive ring 400 whatever the relative position of said ring 400 with respect to spring element 200. These centring portions 230*a*, 240*a* thus guarantee that whatever the circumstances, spring element 200 will always be centred relative to rigid drive ring 400.

Beyond centring portions 230*a*, 240*a*, coupling portions 230*b*, 240*b* of arms 230, 240 become progressively closer to the centre of spring element 200 and the free end of said coupling portions has a protruding portion 230*c*, 240*c* whose highest point defines a second external diameter D'2 of spring element 200, which is larger than the first inner diameter D1 of rigid ring 400. Thus, when rigid ring 400 is driven in rotation, it drives in turn spring element 200 by abutting, via bumps 280, against protruding portions 230*c*, 240*c* of coupling portions 230*b*, 240*b* of arms 230, 240 of spring element 200. This is true until spring element 200 opposes a resistant torque such that arms 230, 240 are elastically deformed and the protruding portions 230*c*, 240*c* thereof pass under bumps 280 of rigid ring 400. At that moment, rigid ring 400 no longer grips spring element 200 and crown 32 rotates without transmitting any torque.

Figure 3:
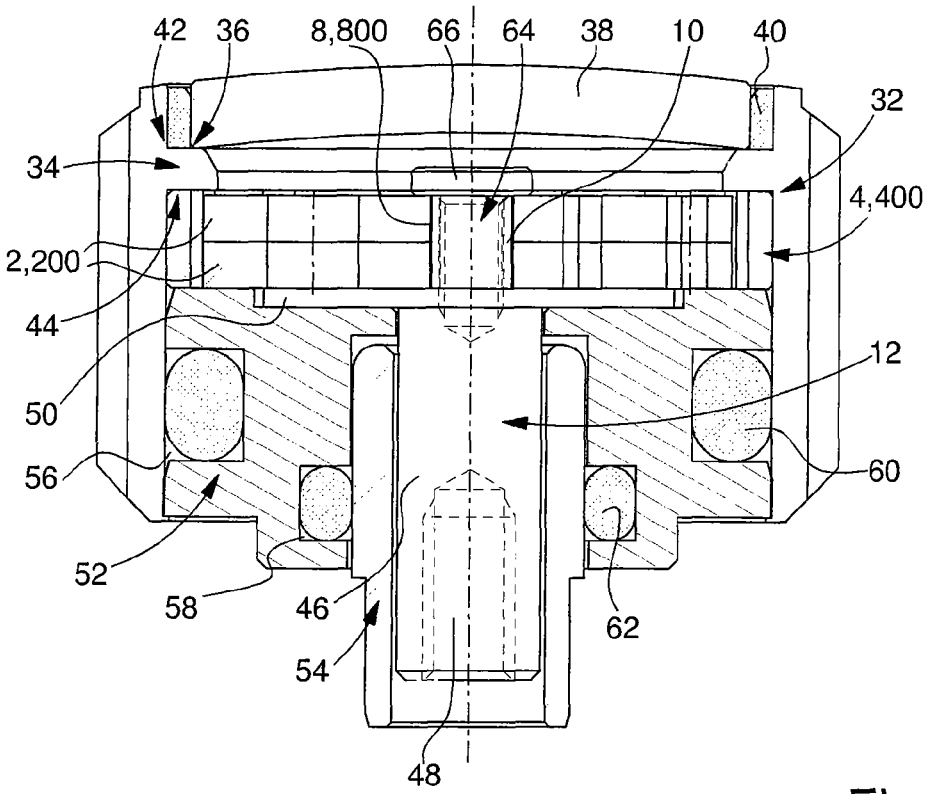
FIG. 3 is a longitudinal cross-section of a crown in which the uncoupling mechanism according to the invention is arranged.

An example of the uncoupling mechanism according to the invention integrated in a winding crown 32 is illustrated in FIG. 3. In its hollow inner housing, crown 32 has a circular shoulder 34, which delimits, on the one hand, an abutment surface 36 for a cover 38 mounted with the insertion of a sealing gasket 40 in an aperture 42 made in said crown 42, and, on the other hand, a stop surface 44 for rigid drive ring 4, 400 and for one, and preferably two, spring elements 2, 200 mounted one above the other.

Pipe 12 has a main part 46 of cylindrical shape in which a threaded hole 48 is made for mounting a winding stem (not shown). A disc shaped head 50, whose diameter is larger than the diameter of main part 46, is mounted on said main part 46 of pipe 12. The projecting portion 10, on which the two spring elements 2, 200 are positioned is mounted on head.

The two spring elements 2, 200 are supported partly on head 50 of pipe 12 and partly on a bush 52, which is mounted in the inner volume of crown 32 via any appropriate means such as driving in, welding, bonding or other means.

Crown 32 is mounted with its uncoupling mechanism in the middle part of a timepiece via a tube 54 fixed to said middle part for example by being driven therein.

The bush has two circular grooves 56 and 58 which house two sealing gaskets 60 and 62 providing a seal between crown 32 and bush 52 on the one hand, and between bush 52 and tube 54 on the other hand.

Finally, a screw 64 is screwed into projecting portion 10 such that springs 2, 200 are held between head 66 of the screw and head 50 of pipe 12.

Rigid drive ring 4, 400 is secured to crown 32, whereas spring elements 2, 200 are secured to pipe 12.

It goes without saying that the present invention is not limited to the embodiments that have just been described and that various simple alterations and variants could be envisaged by those skilled in the art without departing from the scope of the invention as defined by the annexed claims. In particular, it is entirely possible to envisage the spring elements comprising coupling springs that deform along a parallel direction to the tangent to the circle in which said spring elements are inscribed.

What is claimed is:

1. A winding crown assembly for a timepiece including:

a. a crown;

b. an uncoupling mechanism comprising i. a rigid drive ring secured to the crown, ii. a pipe, iii. at least one elastically deformable element secured to the pipe, and operably connected to form a drive connection with the rigid drive ring, and iv. a winding stem secured to one end of the pipe, wherein the rigid ring cooperates with the elastically deformable element to drive the elastically deformable element in at least one rotational direction until a resistant torque opposed by the elastically deformable element exceeds a threshold value beyond which the elastically deformable element is deformed so as to interrupt the drive connection with the rigid drive ring;

wherein the elastically deformable element further comprises coupling portions arranged to temporarily couple the elastically deformable element to the rigid drive ring, and centering portions arranged to center the elastically deformable element within the rigid drive ring, wherein the elastically deformable element is of substantially circular shape;

wherein an inner perimeter of the rigid drive ring has an uninterrupted series of bumps and hollows which respectively define first and second inner diameters, the first inner diameter being smaller than the second inner diameter;

wherein the centering portions are arranged diametrically opposite to each other on the perimeter of said elastically deformable element;

wherein the elastically deformable element includes two arms each having one centering portion and one coupling portion; and wherein the centering portions have the shape of an arc of a circle which defines a first external diameter of the elastically deformable element equal to the first inner diameter of the rigid drive ring, the length of said centering portions being such that said centering portions always rest on two successive bumps on the inner perimeter of the rigid drive ring, and wherein the coupling portions have protruding portions the tips of which define a second external diameter of the elastically deformable element which is larger than the first inner diameter of the rigid drive ring.

2. The winding crown assembly according to claim 1, wherein the elastically deformable element includes a base of substantially circular shape pierced at the center thereof with a hole via which said elastically deformable element is secured to a projecting portion of the pipe, the base being extended by two diametrically opposite bent portions which are followed by the arms, said arms developing circularly in the same direction.

3. A winding crown assembly for a timepiece including:

a. a crown;

b. an uncoupling mechanism comprising i. a rigid drive ring secured to the crown, ii. a pipe, iii. at least one elastically deformable element secured to the pipe, and operably connected to form a drive connection with the rigid drive ring, and iv. a winding stem secured to one end of the pipe, wherein the rigid ring cooperates with the elastically deformable element to drive the elastically deformable element in at least one rotational direction until a resistant torque opposed by the elastically deformable element exceeds a threshold value beyond which the elastically deformable element is deformed so as to interrupt the drive connection with the rigid drive ring;

wherein the elastically deformable element further comprises coupling portions arranged to temporarily couple the elastically deformable element to the rigid drive ring, and centering portions arranged to center the elastically deformable element within the rigid drive ring;

wherein the elastically deformable element is of substantially circular shape, wherein an inner perimeter of the rigid drive ring has an uninterrupted series of bumps and hollows which respectively define first and second inner diameters, the first inner diameter being smaller than the second inner diameter;

wherein the centering portions are provided at three regularly spaced places on the perimeter of said elastically deformable element; and wherein the centering portions take the form of three Y-shaped arms and wherein the coupling portions take the form of three Ω-shaped parts each inserted between two successive arms, each coupling portion including a head and two legs, which define a surface open towards the inside of the elastically deformable element.

4. The winding crown assembly according to claim 3, wherein the coupling arms each include a section, which extends radially from the center of the elastically deformable element and which separates into two symmetrical branches which get progressively further apart, the two branches of each arm being joined to each other by a centering portion in the shape of an arc of a circle which defines a first external radius of the elastically deformable element, which corresponds to a diameter equal to the first inner diameter of the rigid drive ring, the length of said centering portions being such that said centering portions always rest on two successive bumps on the inner perimeter of the drive ring, and wherein the tip of the coupling portions defines a second external radius of the elastically deformable element, which is larger than the first inner diameter of the rigid drive ring.

5. The winding crown assembly according to claim 4, wherein the centering portions are extended at the free ends thereof by connecting portions, which connect the centering arms to the feet of the coupling portions.

* * * * *